US009382645B2

(12) United States Patent
Hoover

(10) Patent No.: US 9,382,645 B2
(45) Date of Patent: Jul. 5, 2016

(54) OVERFEED ROLLER ASSEMBLY, TEXTILE MACHINE, AND METHOD OF ADJUSTING TENSION IN A RUNNING YARN

(75) Inventor: Donald Lynn Hoover, Clover, SC (US)

(73) Assignee: American Linc, LLC, Gastonia, NC (US)

( * ) Notice: Subject to any disclaimer, the term of this patent is extended or adjusted under 35 U.S.C. 154(b) by 253 days.

(21) Appl. No.: 14/126,227

(22) PCT Filed: Jun. 18, 2012

(86) PCT No.: PCT/US2012/042915

§ 371 (c)(1), (2), (4) Date: Apr. 3, 2014

(87) PCT Pub. No.: WO2012/174514

PCT Pub. Date: Dec. 20, 2012

(65) Prior Publication Data

US 2014/0202129 A1 Jul. 24, 2014

Related U.S. Application Data

(60) Provisional application No. 61/520,860, filed on Jun. 16, 2011.

(51) Int. Cl.

| | |
|---|---|
| ***D01H 1/10*** | (2006.01) |
| ***D01H 7/02*** | (2006.01) |
| ***B65H 59/18*** | (2006.01) |
| ***B65H 51/06*** | (2006.01) |

(52) U.S. Cl.

CPC ..... *D01H 1/103* (2013.01); *B65H 51/06* (2013.01); *B65H 59/18* (2013.01); *D01H 1/10* (2013.01); *D01H 7/02* (2013.01); *B65H 2701/31* (2013.01)

(58) Field of Classification Search

CPC ..... B65H 1/06; B65H 9/18; B65H 2701/31

See application file for complete search history.

(56) References Cited

U.S. PATENT DOCUMENTS

| | | | | |
|---|---|---|---|---|
| 2,656,126 | A | 10/1953 | Kingsbury et al. | |
| 2,945,636 | A | 7/1960 | Walter | |
| 4,058,245 | A | 11/1977 | Hurt et al. | |
| 4,168,605 | A * | 9/1979 | D'Agnolo | D01H 15/007 57/279 |
| 4,346,551 | A | 8/1982 | Yanobu et al. | |
| 4,413,981 | A * | 11/1983 | White | F16H 55/50 474/175 |
| 4,693,068 | A | 9/1987 | Matas Gabalda | |
| 4,709,543 | A | 12/1987 | Lorenz | |

(Continued)

FOREIGN PATENT DOCUMENTS

| | | | |
|---|---|---|---|
| AT | 184 494 | B | 1/1956 |
| WO | WO 90/07600 | A1 | 7/1990 |

*Primary Examiner* — Shaun R Hurley

(74) *Attorney, Agent, or Firm* — Schwartz Law Firm, P.C.

(57) ABSTRACT

An overfeed roller assembly for use on a rotating drive shaft of a textile machine is adapted for adjusting downstream tension in a continuous moving length of yarn. The overfeed roller assembly comprises a base assembly designed for mounting on the drive shaft, and an annular yarn tension adjuster carried by the base assembly. The tension adjuster comprises opposing closely spaced yarn-contacting walls. The yarn-contacting walls define a shallow generally serpentine depression in the tension adjuster adapted for receiving the continuous moving length of yarn. Yarn tension downstream of the roller assembly is thereby reduced as the moving yarn meanders through the tension adjuster in frictional contact with the yarn-contacting walls of the serpentine depression.

16 Claims, 7 Drawing Sheets

(56) References Cited

U.S. PATENT DOCUMENTS 4,725,015 A 2/1988 Zitzen
5,224,252 A 7/1993 Baker et al.
5,957,402 A * 9/1999 McEathron ..... B65H 51/015 242/155 R
6,446,853 B1 * 9/2002 Schmodde ..... D04B 15/48 226/174
2007/0169830 A1 * 7/2007 Christe ..... B65H 59/22 139/448
2010/0187349 A1 * 7/2010 Pemberton ..... B65H 49/32 242/566

* cited by examiner

OVERFEED ROLLER ASSEMBLY, TEXTILE MACHINE, AND METHOD OF ADJUSTING TENSION IN A RUNNING YARN

TECHNICAL FIELD AND BACKGROUND OF THE INVENTION

This invention relates generally an overfeed (or "pre-take-up") roller assembly, textile machine, and method of adjusting tension in a running yarn being wound by a take-up mechanism. The exemplary assemblies and methods described herein may be utilized to obtain a relatively soft wound package in a thread-processing machine, such as a two-for-one twister (also referred to as a "double twister" or "yarn cabler").

In a conventional two-for-one twister, a yarn coming from a double twisting spindle ordinarily has a high tension increased by ballooning. Accordingly, an overfeed feed roller is arranged between the double twisting spindle and a take-up roller to overfeed the yarn and reduce the yarn tension, and the yarn having a reduced tension is passed through a traverse device and wound on a rotating package by the take-up roller. In forming wound packages by such double twister, especially in case of processed yarns, the tension given by ballooning must be sufficiently reduced by the overfeed roller in order to obtain a softer wound package, and the resulting soft wound package may then be fed to a subsequent textile process, such as heat-setting.

In exemplary embodiments described below, the present invention comprises an improved overfeed roller assembly designed to adjust the tractive force and tension on a running thread being wound by a take-up mechanism in a thread processing machine, such as a two-for-one twister, and positioned in the machine in advance of the take-up mechanism in the running thread path. The present overfeed roller assembly may comprise multiple pieces (e.g., two identical semi-circular halves) designed for ready and convenient assembly and disassembly on a variably driven rotating drive shaft carried by the machine.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

According to one exemplary embodiment, the present disclosure relates to an overfeed roller assembly for use on a rotating drive shaft of a textile machine and adapted for adjusting downstream tension in a continuous moving length of yarn. The overfeed roller assembly comprises a base assembly designed for mounting on the drive shaft, and an annular yarn tension adjuster carried by the base assembly. The tension adjuster comprises opposing closely spaced yarn-contacting walls. The yarn-contacting walls define a shallow generally serpentine depression in the tension adjuster adapted for receiving the continuous moving length of yarn. Yarn tension downstream of the roller assembly is thereby reduced as the moving yarn meanders through the tension adjuster in frictional contact with the yarn-contacting walls of the serpentine depression. In this exemplary embodiment, the base assembly and yarn tension adjuster may be separately formed in multiple parts, or may be integrally formed together as a single homogenous unit.

The term "serpentine" is used broadly herein to mean a uniformly (or non-uniformly) winding or snake-like formation.

The term "closely spaced" means sufficiently spaced apart to allow serpentine passage of the yarn between the yarn-contacting walls such that the yarn frictionally engages the walls to reduce downstream tension.

According to another exemplary embodiment, a top surface of the tension adjuster angles downwardly towards each of the yarn-contacting walls.

According to another exemplary embodiment, each yarn-contacting wall angles outwardly from a bottom of the serpentine depression towards the top surface of the tension adjuster.

According to another exemplary embodiment, each yarn-contacting wall of the tension adjuster is formed at an outward angle of between about 5 and 10 degrees.

According to another exemplary embodiment, the tension adjuster comprises a generally flat bottom surface located between the opposing yarn-contacting walls.

According to another exemplary embodiment, the bottom surface of the tension adjuster has a width dimension of between about 0.060 and 0.130 inches.

According to another exemplary embodiment, the serpentine depression has a depth of between about 0.15 and 0.30 inches measured generally from the top surface of the tension adjuster to the bottom surface of the tension adjuster.

According to another exemplary embodiment, the yarn-contacting walls of the tension adjuster comprise a material coating selected from a group consisting of ceramic and plasma. Alternatively, the tension adjusters may comprise anodized aluminum or solid ceramic.

In another exemplary embodiment, the present disclosure comprises an overfeed roller assembly for use on a rotating drive shaft of a textile machine and adapted for adjusting downstream tension in a continuous moving length of yarn. The roller assembly includes a base assembly designed for mounting on the drive shaft, and a plurality of arcuate yarn tension adjusters carried by the base assembly. Each tension adjuster comprises opposing closely spaced yarn-contacting walls defining a shallow depression adapted for receiving the continuous moving length of yarn, whereby yarn tension downstream of the roller assembly is reduced as the moving yarn passes through the arcuate tension adjusters in frictional contact with the yarn-contacting walls of the shallow depression. In this exemplary embodiment, the generally shallow depression may follow a substantially arcuate or straight path (or any other path formation) across the top surface of the tension adjuster.

According to another exemplary embodiment, the base assembly includes a mounting sleeve adapted for being affixed to the drive shaft (e.g., by setscrew), and first and second opposing end caps carried by the mounting sleeve and cooperating to secure the arcuate tension adjusters therebetween.

According to another exemplary embodiment, the first end cap of the base assembly comprises a threaded hollow male connector extending over the mounting sleeve. The second end cap of the base assembly defines a complementary-threaded female opening designed to releasably mate with the threaded connector of the first end cap.

According to another exemplary embodiment, the mounting sleeve of the base assembly defines annular grooves, and further comprises respective rubber O-rings located in the grooves to frictionally engage the hollow male connector of the first end cap, thereby frictionally holding the assembled first and second end caps onto the mounting sleeve.

According to another exemplary embodiment, the first and second end caps of the base assembly comprise respective annular shoulders cooperating to position the arcuate tension adjusters within the roller assembly.

According to another exemplary embodiment, the arcuate tension adjusters comprise respective arcuate edge tongues designed to insert within corresponding arcuate grooves formed with the first and second ends caps of the base assembly.

According to another exemplary embodiment, the plurality of arcuate tension adjusters comprise first and second semicircular tension adjusters cooperating to form 360-degrees around (e.g., encircle) the base assembly.

In yet another exemplary embodiment, the present disclosure comprises a method for adjusting tension in a moving continuous length of yarn. The method includes feeding the moving yarn downstream through a generally serpentine depression formed with an overfeed roller assembly. Tension in the moving yarn is then reduced as it passes in frictional contact with yarn-contacting walls of the serpentine depression.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
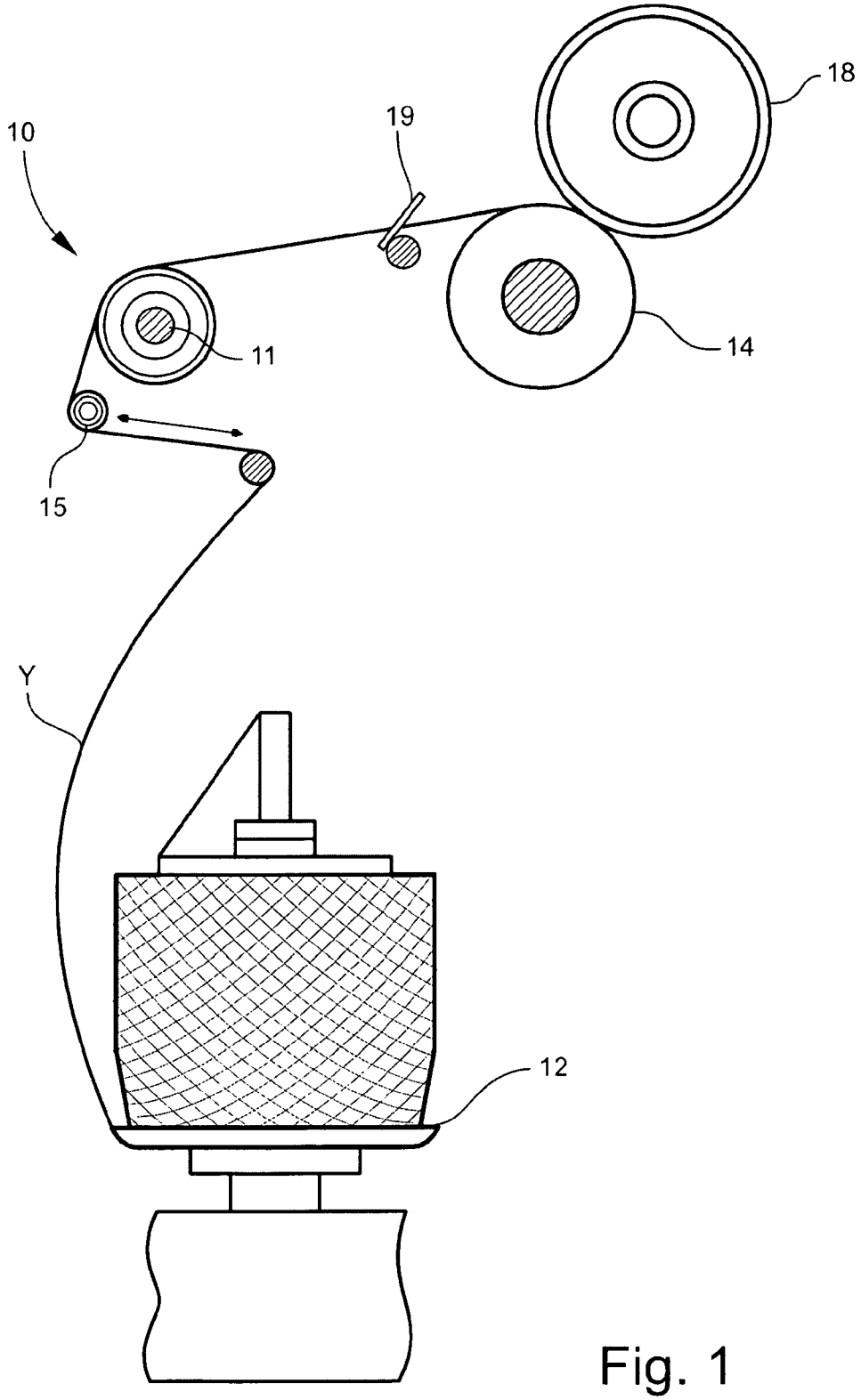
FIG. 1 is a schematic view of a textile machine incorporating an overfeed roller assembly according to one exemplary embodiment of the present disclosure.

Referring now specifically to FIG. 1 of the drawings, the present exemplary overfeed roller assembly 10 is installed on a variably-driven rotating drive shaft 11 of a textile machine between a double twisting spindle 12 and a take-up roller 14. In one exemplary embodiment, a moving yarn "Y" coming from the double twisting spindle 12 is passed through a winding angle-adjusting device 15 and wound on the overfeed roller 10 at a predetermined winding angle. The tension on the yarn "Y" delivered from the overfeed roller 10 is reduced, and the yarn "Y" wound on the package 18 through a conventional traverse device 19 or other appropriate mechanism.

Figure 2:
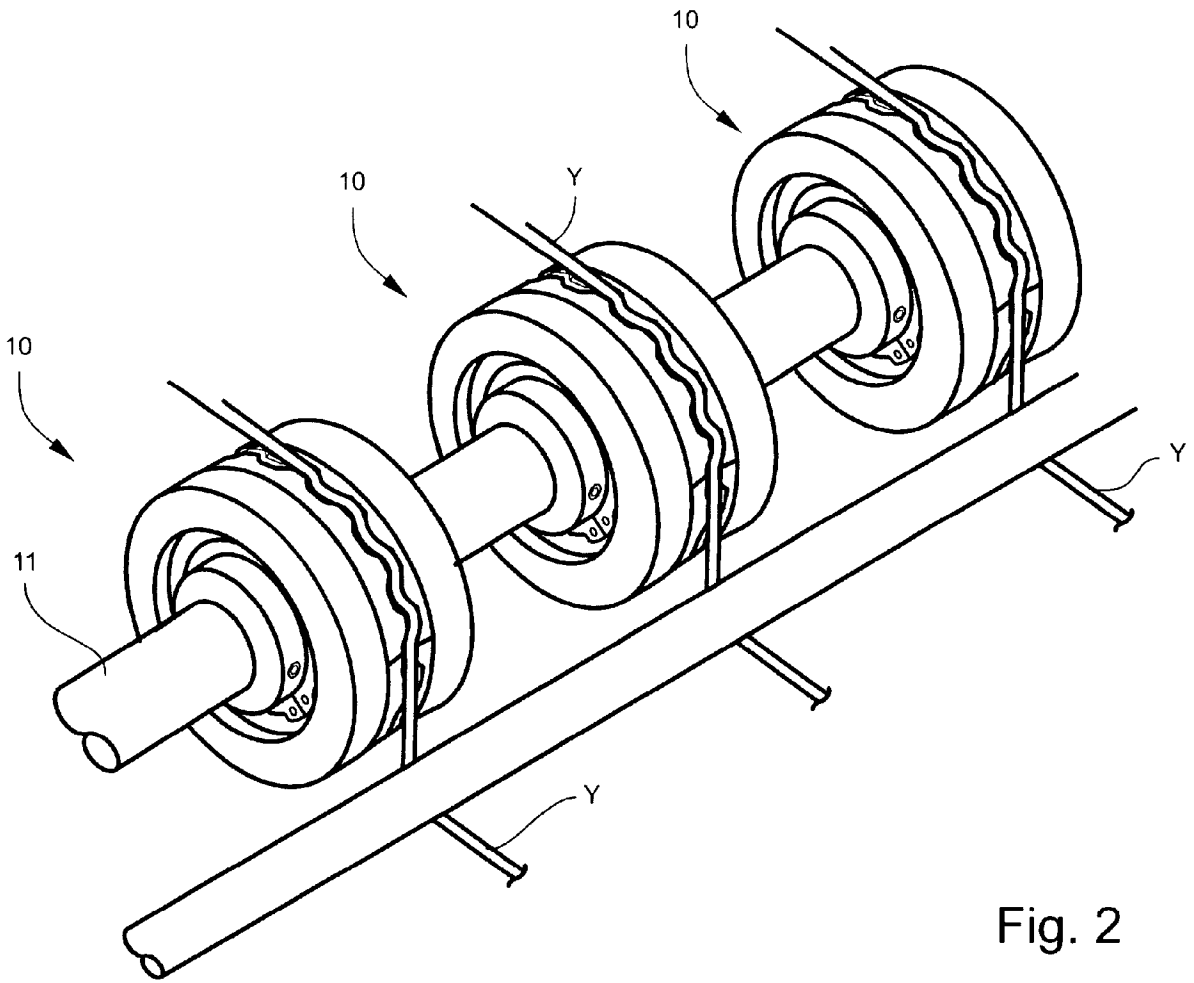
FIG. 2 is a view illustrating multiple overfeed roller assemblies carried on a single drive shaft.

In conventional machines, a single drive shaft 11 may carry several (e.g. 4 to 8) identical, spaced-apart overfeed roller assemblies 10 affixed to the shaft, as shown in FIG. 2—each overfeed roller assembly 10 delivering tension-adjusted yarns "Y" downstream to respective take-up rollers 14 and packages 18. To facilitate exchange or replacement, the exemplary overfeed roller assembly 10 may be constructed in multiple readily assembled and disassembled pieces.

Figure 3:
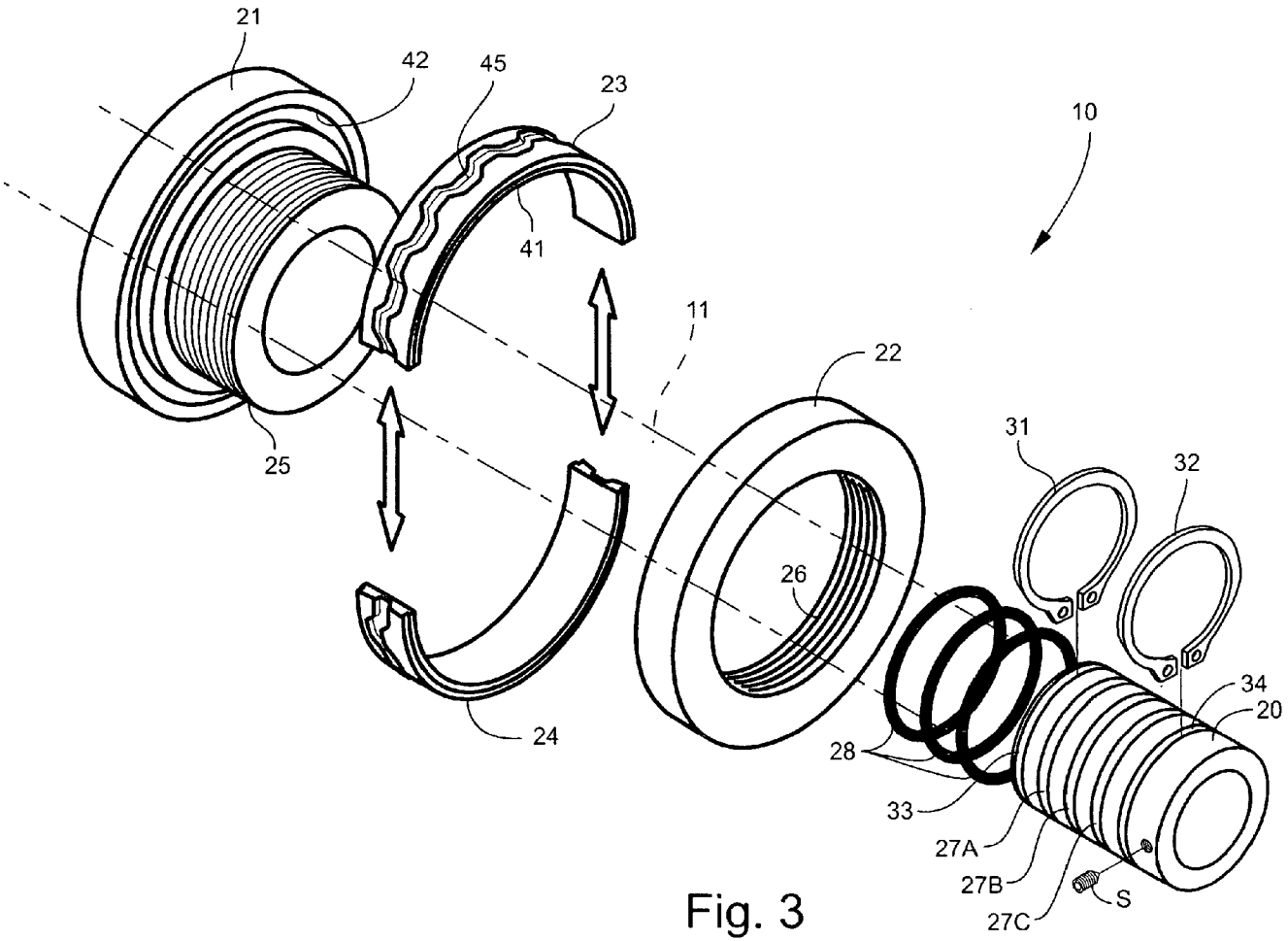
FIG. 3 is an exploded view of the overfeed roller assembly.
Figure 4:
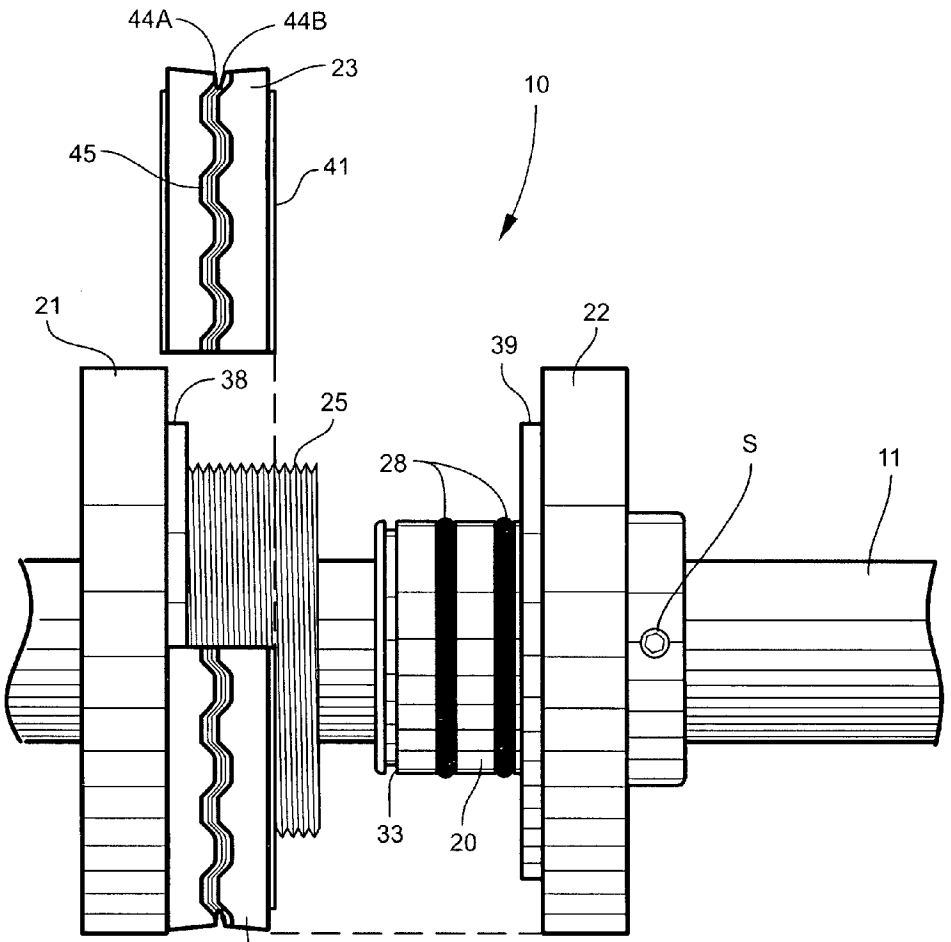
FIG. 4 is a partial exploded view of the exemplary overfeed roller assembly showing the male end cap removed from the mounting sleeve during assembly/disassembly of the yarn tension adjusters on the drive shaft.
Figure 5:
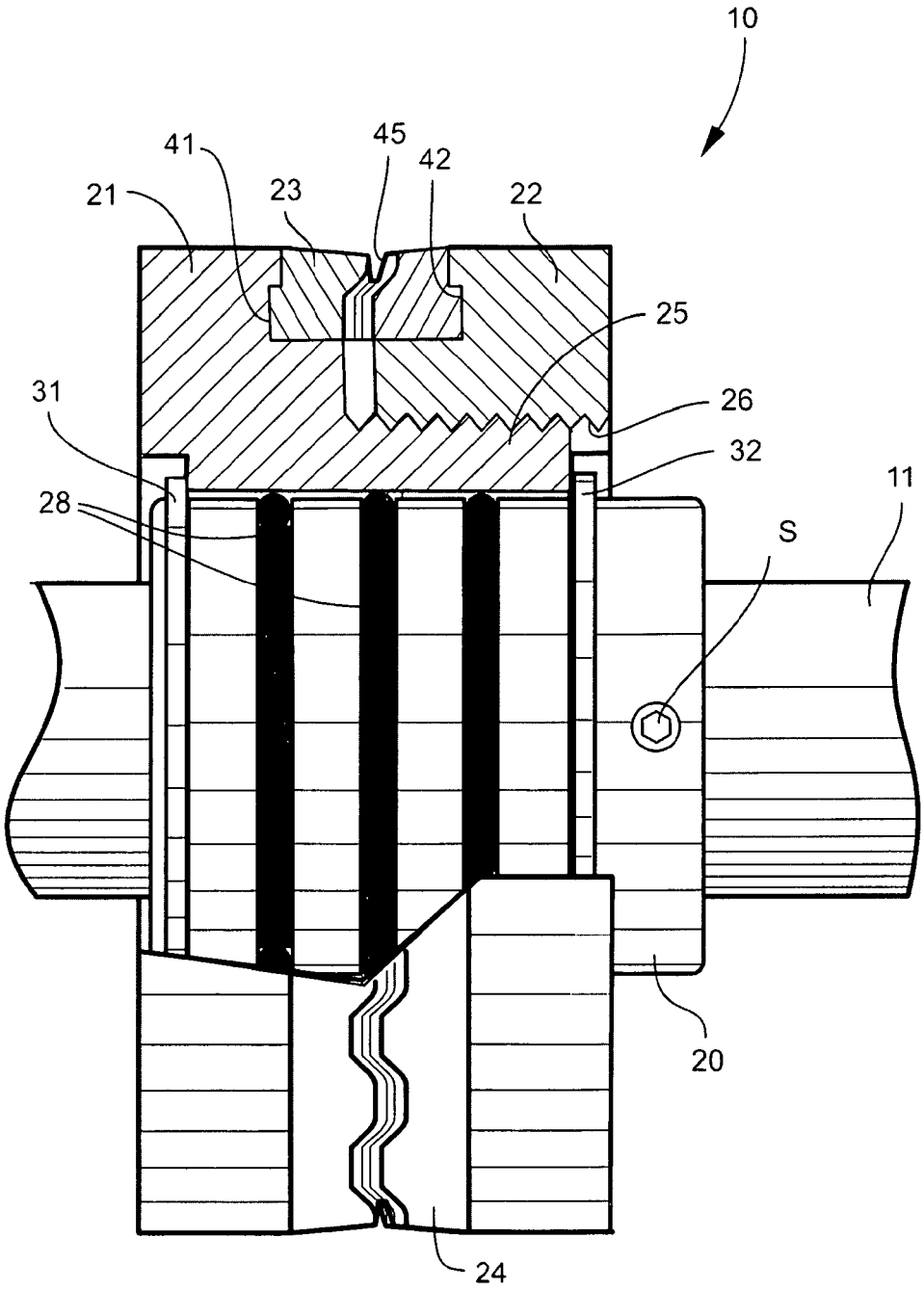
FIG. 5 is a view showing the overfeed roller assembly arranged and assembled on the drive shaft with portions of the assembly shown in cross-section.

Referring to FIGS. 3, 4, and 5, the present overfeed roller assembly 10 includes a base assembly comprising a hollow cylindrical steel mounting sleeve 20 designed for being carried by and immovably affixed to the drive shaft 11 (e.g., via set screw "S" or other hardware), and opposing first and second end caps 21, 22 having respective center openings each with an inner diameter slightly larger than an outer diameter of the mounting sleeve 20. When assembled on the mounting sleeve 20, as described below, the end caps 21, 22 cooperate to tightly sandwich and frictionally hold replaceable semi-circular yarn tension adjusters 23, 24. The first end cap 21 has an externally-threaded hollow male connector 25 which slides over the mounting sleeve 20, and mates with a complementary-threaded female opening 26 formed with the second end cap 22 on opposite sides of the assembled tension adjusters 23, 24.

The exemplary mounting sleeve 20 defines longitudinally-spaced annular grooves 27A, 27B, 27C (FIG. 3) which receive respective rubber O-rings 28. The O-rings 28 frictionally engage the hollow male connector 25 of the first end cap 21, as shown in FIG. 5, and allow frictional slippage of the mated end caps 21, 22 and tension adjusters 23, 24 when a maximum yarn tension is exceeded. The maximum yarn tension (before slippage occurs) may be adjusted by using three or fewer O-rings 28 on the mounting sleeve 20. For example, two O-rings will allow slippage of the assembly at a lesser yarn tension as compared to three O-rings. Spaced metal retaining rings 31, 32 reside in annular grooves 33, 34 formed with the mounting sleeve 20, and serve to maintain the mated end caps 21, 22 and tension adjusters 23, 24 in proper position on the mounting sleeve 20 during operation of the drive shaft 11. The tension adjusters 23, 24 reside on inwardly-facing annular shoulders 38, 39 formed with the end caps 21, 22, and have arcuate edge tongues 41 designed to insert within corresponding arcuate grooves 42 formed with the ends caps 21, 22 to lock and hold the tension adjusters 23, 24 in place.

In one exemplary embodiment, each tension adjuster 23, 24 comprises closely spaced yarn-contacting walls 44A, 44B (FIG. 8) defining a shallow generally serpentine depression 45 through which the running yarn "Y" is fed out to its designated take-up roller 14 and package 18 shown in FIG. 1. Alternating projections or "teeth" 46, 46', referenced in FIG. 6, as defined by the yarn-contacting walls 44A, 44B, are uniformly spaced-apart and may overlap slightly along the arcuate travel path of the yarn through the serpentine depression 45. The relative degree of "teeth overlap" may be modified in alternative tension adjusters 23, 24 to further control tension in the running yarn. The relatively high yarn tension on the side of the double twisting spindle 12 is gradually reduced as the yarn "Y" meanders through the serpentine depression 45 of the overfeed roller assembly 10 in frictional contact with the spaced yarn-contacting walls 44A, 44B. The yarn-contacting walls 44A, 44B may comprise a ceramic or plasma coating (or other hard-coated oxide), or may be chromium plated. Rotation of the drive shaft 11 is varied in such a manner that the circumferential speed of the affixed overfeed roller assemblies 10 at the surfaces in contact with the yarns is distinctively higher than the speed of travel of the running yarns. The drive shaft 11 and take-up roller 14 may be operatively connected in a known manner using a clutch mechanism.

Figure 6:
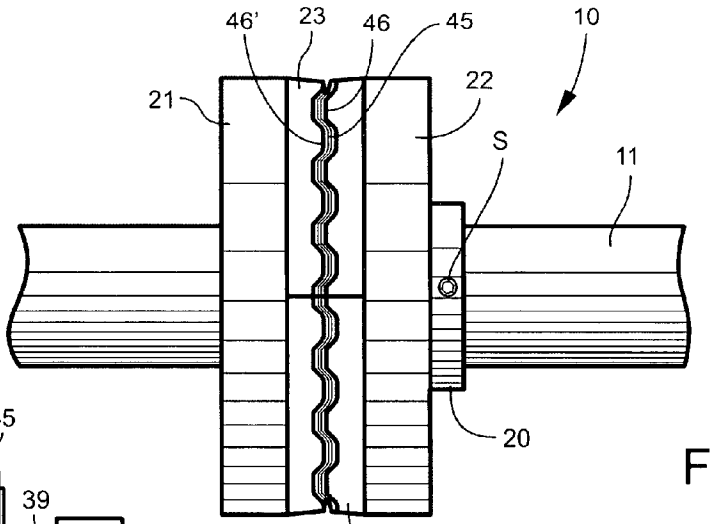
FIG. 6 shows the overfeed roller assembly arranged and assembled on the drive shaft.
Figure 7:
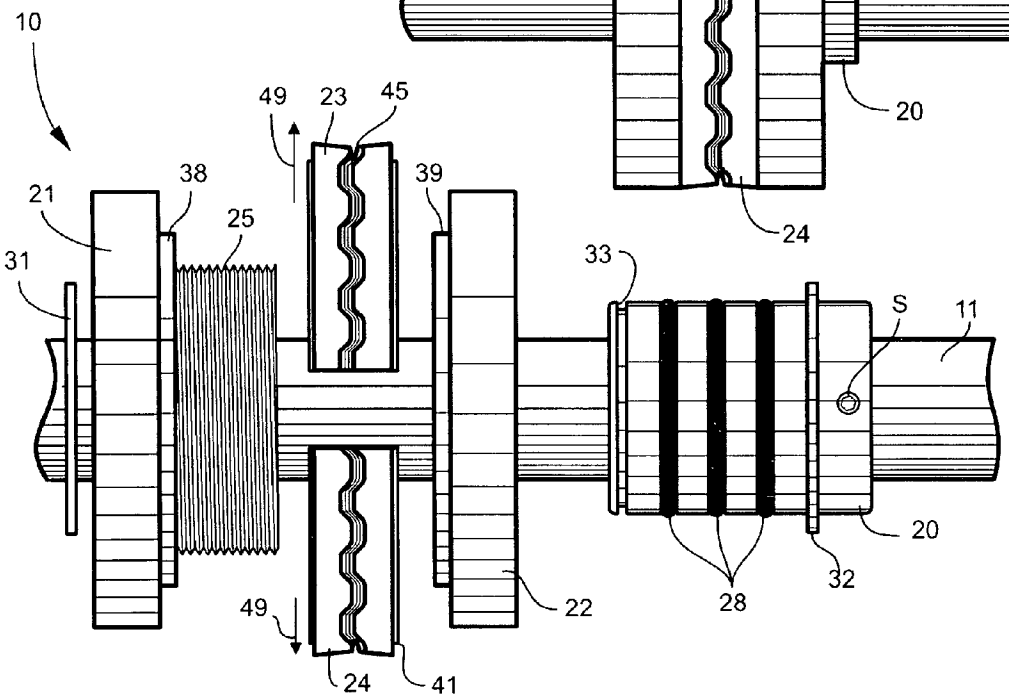
FIG. 7 shows the overfeed roller assembly disassembled on the drive shaft during the process of exchanging/replacing one or both of the yarn tension adjusters.

Referring to FIGS. 6 and 7, in order to replace the one or both yarn tension adjusters 23, 24 of the overfeed roller assembly 10, at least one of the metal retaining rings 31, 32 may be first removed from the affixed mounting sleeve 20, and the assembled end caps 21, 22 are then unscrewed and one separated from the other along the drive shaft 11. During disassembly and reassembly, one of the end caps 21, 22 may remain frictionally held on the mounting sleeve 20, while the mounting sleeve 20 remains affixed to the drive shaft 11. With the end caps 21, 22 separated, as shown in FIG. 7, the semi-circular tension adjusters 23, 24 can be moved apart as indicated at arrows 49 and removed from the assembly 10 in situ for exchange or replacement. A reverse process may be undertaken to re-assemble components of the overfeed roller assembly 10 on the drive shaft 11. Accordingly, the tension adjusters 23, 24 may be readily replaced or exchanged without first removing the entire overfeed roller assembly 10 and all intervening assemblies 10 from a free end of the drive shaft 11. In one implementation, the tension adjusters 23, 24 are disassembled for replacement by merely loosening (slightly unscrewing) the mating end caps 21, 22 without also first removing either retaining ring 31, 32 on the mounting sleeve 20.

Figure 8:
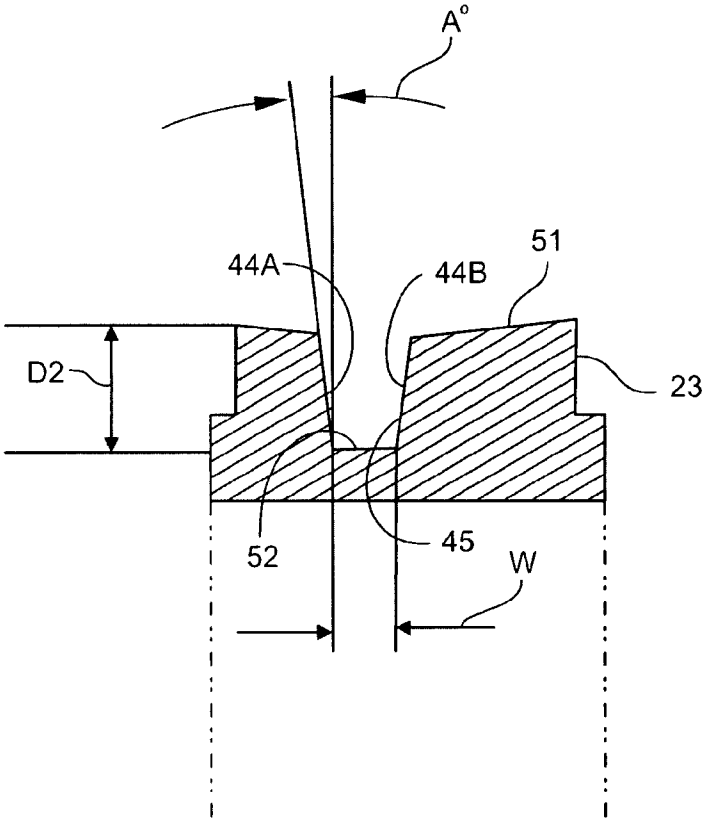
FIG. 8 is an enlarged, fragmentary, cross-sectional view of a yarn tension adjuster.

FIG. 8 illustrates an enlarged fragmentary portion of the tension adjuster 23 (tension adjuster 24 being identical) at the shallow serpentine depression 45. In one exemplary embodiment, a top surface 51 of the tension adjuster 23 angles downwardly towards each of the yarn-contacting walls 44A, 44B. Each yarn-contacting wall 44A, 44B angles outwardly (e.g., about 5-10 degrees) from a generally flat bottom surface 52 of the serpentine depression 45 towards the top surface 51 of the tension adjuster 23, as indicated at angle "A" The flat bottom surface 52 of the tension adjuster 23 is formed between the opposing walls 44A, 44B, and has a width dimension "W" of between about 0.06 and 0.13 inches. The serpentine depression 45 formed with exemplary tension adjuster 23 has a depth "D" of between about 0.15 and 0.30 inches measured generally from the top surface 51 of the tension adjuster 23 to the bottom surface 52 of the tension adjuster 23.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. An overfeed roller assembly for use on a rotating drive shaft of a textile machine and adapted for adjusting downstream tension in a continuous moving length of yarn, said roller assembly comprising:

a base assembly designed for mounting on the drive shaft;

a plurality of arcuate yarn tension adjusters carried by said base assembly, and wherein said base assembly comprises a mounting sleeve adapted for being affixed to the drive shaft, and first and second opposing end caps carried by the mounting sleeve and cooperating to secure said arcuate tension adjusters therebetween, each tension adjuster comprising opposing closely spaced yarn-contacting surfaces defining a pathway along said tension adjuster adapted for receiving the continuous moving length of yarn, whereby yarn tension downstream of said roller assembly is reduced as the moving yarn passes through said arcuate tension adjusters in frictional contact with the yarn-contacting surfaces of the pathway.

2. The overfeed roller assembly according to claim 1, wherein the first end cap of said base assembly comprises a threaded hollow male connector extending over the mounting sleeve, and wherein the second end cap of said base assembly defines a complementary-threaded female opening designed to releasably mate with the threaded connector of the first end cap.

3. The overfeed roller assembly according to claim 2, wherein the mounting sleeve of said base assembly defines annular grooves, and further comprises respective rubber O-rings located in the grooves to frictionally engage the hollow male connector of said first end cap, thereby frictionally holding the assembled first and second end caps onto said mounting sleeve.

4. The overfeed roller assembly according to claim 1, wherein the first and second end caps of said base assembly comprise respective annular shoulders cooperating to position said arcuate tension adjusters within said roller assembly.

5. The overfeed roller assembly according to claim 1, wherein said arcuate tension adjusters comprise respective arcuate edge tongues designed to insert within corresponding arcuate grooves formed with the first and second ends caps of said base assembly.

6. The overfeed roller assembly according to claim 1, wherein said plurality of arcuate tension adjusters comprise first and second semi-circular tension adjusters cooperating to form around said base assembly.

7. The overfeed roller assembly according to claim 1, wherein each arcuate tension adjuster comprises a bottom surface located between said opposing yarn-contacting surfaces.

8. The overfeed roller assembly according to claim 7, wherein the yarn pathway of each arcuate tension adjuster has a depth of between about 0.15 and 0.30 inches measured from the top surface of said tension adjuster to the bottom surface of said tension adjuster.

9. An overfeed roller assembly for use on a rotating drive shaft of a textile machine and adapted for adjusting downstream tension in a continuous moving length of yarn, said roller assembly comprising:

a base assembly designed for mounting on the drive shaft;

first and second semi-circular arcuate tension adjusters cooperating to form around said base assembly, each tension adjuster comprising opposing closely spaced yarn-contacting surfaces defining a pathway along said tension adjuster adapted for receiving the continuous moving length of yarn, whereby yarn tension downstream of said roller assembly is reduced as the moving yarn passes through said arcuate tension adjusters in frictional contact with the yarn-contacting surfaces of the pathway.

10. The overfeed roller assembly according to claim 9, wherein said base assembly comprises a mounting sleeve adapted for being affixed to the drive shaft, and first and second opposing end caps carried by the mounting sleeve and cooperating to secure said arcuate tension adjusters therebetween.

11. The overfeed roller assembly according to claim 9, wherein the first end cap of said base assembly comprises a threaded hollow male connector extending over the mounting sleeve, and wherein the second end cap of said base assembly defines a complementary-threaded female opening designed to releasably mate with the threaded connector of the first end cap.

12. The overfeed roller assembly according to claim 11, wherein the mounting sleeve of said base assembly defines annular grooves, and further comprises respective rubber O-rings located in the grooves to frictionally engage the hollow male connector of said first end cap, thereby frictionally holding the assembled first and second end caps onto said mounting sleeve.

13. The overfeed roller assembly according to claim 10, wherein the first and second end caps of said base assembly comprise respective annular shoulders cooperating to position said arcuate tension adjusters within said roller assembly.

14. The overfeed roller assembly according to claim 9, wherein said arcuate tension adjusters comprise respective arcuate edge tongues designed to insert within corresponding arcuate grooves formed with the first and second ends caps of said base assembly.

15. The overfeed roller assembly according to claim 9, wherein each arcuate tension adjuster comprises a bottom surface located between said opposing yarn-contacting surfaces.

16. The overfeed roller assembly according to claim 15, wherein the yarn pathway of each arcuate tension adjuster has a depth of between about 0.15 and 0.30 inches measured from the top surface of said tension adjuster to the bottom surface of said tension adjuster.

* * * * *